US006209781B1

(12) United States Patent
Sylvester et al.

(10) Patent No.: US 6,209,781 B1
(45) Date of Patent: Apr. 3, 2001

(54) DISPOSABLE, FOLDABLE CONTAINER

(75) Inventors: Carol A. Sylvester, New Brighton; Ted G. Young, Buffalo; Michael Fiterman, Minnetonka, all of MN (US)

(73) Assignee: Liberty Carton Co., New Hope, MN (US)

( * ) Notice: Subject to any disclaimer, the term of this patent is extended or adjusted under 35 U.S.C. 154(b) by 0 days.

(21) Appl. No.: 09/258,225

(22) Filed: Feb. 26, 1999

(51) Int. Cl.[7] ..... B65D 5/74
(52) U.S. Cl. ..... 229/110; 229/117.5; 222/105
(58) Field of Search ..... 222/105, 183; 229/110, 117.5

(56) References Cited

U.S. PATENT DOCUMENTS

| | | | | |
|---|---|---|---|---|
| 3,581,974 | * | 6/1971 | Freeman | 229/110 |
| 4,376,509 | | 3/1983 | Schaffer . | |
| 4,520,948 | | 6/1985 | Hampel . | |
| 4,844,327 | * | 7/1989 | Pausing | 229/110 |
| 4,887,720 | | 12/1989 | Farber . | |
| 4,915,236 | | 4/1990 | Kamin . | |
| 5,125,566 | * | 6/1992 | Deiger | 229/110 |
| 5,377,876 | * | 1/1995 | Smernoff | 222/105 |
| 5,715,992 | * | 2/1998 | Andrew, Sr. et al. | 229/112 |
| 5,771,777 | | 6/1998 | Davis . | |
| 5,829,637 | * | 11/1998 | Takemura et al. | 222/105 |

* cited by examiner

*Primary Examiner*—Philippe Derakshani
(74) *Attorney, Agent, or Firm*—Patterson, Thuente, Skaar & Christensen, P.A.

(57) ABSTRACT

A disposable container includes support structure that is shiftable between a disposable disposition and an erect disposition, the support structure defining an interior container space when in the erect disposition. The erect support structure has a bottom side section and a generally opposed and spaced apart top side section. A first end section extends between the bottom side section and the top side section and has an aperture defined therein, the aperture being disposed proximate the bottom side section. A second end section is spaced apart from the first end section and extends between the bottom side section and the top side section. In a further embodiment, a disposable container includes support structure that is shiftable between a disposable disposition and an erect disposition, the support structure defining an interior container space when in the erect disposition. The erect support structure has a first end section, the first end section having an aperture defined therein, the aperture being disposed proximate a bottom side section. A bladder for holding a liquid is disposable in the interior container space.

14 Claims, 5 Drawing Sheets

10
1
2
130, 131
110a
112a
118a
106a
104
108a
32a
30a
120b
38a
18
52a
64a
62a
90a
24
121
66
76
72a
83
86
78
80
82
84
90b
62b
72b
22
20
120a
64b
16
51
112b
118b
106b
108b
50b
30b
38b
32b
120b
122a
122b
124

10
112b
118b
108b
106b
42b
16
38b
36a
76
20
72b
74
84
86
112a
22
118a
108a
106a
42a
36b
18
38b
60
72a
74
82
83
80
110a
114
104
28b
26
28a
64b
66
64a
152
150
148
14
144
146
148
142

DISPOSABLE, FOLDABLE CONTAINER

BACKGROUND OF INVENTION

1. Field of the Invention

The present invention relates to disposable containers. More particularly, the present invention relates to containers for storing and dispensing a liquid.

2 Description of Related Art

With the increased use of what can be characterized as up-scale coffee at meetings and the like, there is a need to provide an economical service of supplying such coffee from an off site location. Typically, the coffee is ordered from a shop specializing in what can be characterized as "up-scale" coffee. Most usually, the coffee is delivered in relatively large vacuum containers. A problem with such delivery is that the vacuum containers must be retrieved by the coffee shop sometime after the conclusion of the consumption of the coffee contained therein. Typically what this entails is that a person from the coffee shop must coordinate a return trip to retrieve the vacuum containers. This trip is sometimes difficult to coordinate and certainly entails the time of at least one person to make the return trip to retrieve the empty vacuum containers. Alternatively, a fiber beverage container may be used to transport the coffee. Such beverage container is detailed in U.S. Pat. No. 5,715,992. The beverage container disclosed in the '992 patent has a major disadvantage from an ergonomic standpoint. The spout out of which the coffee is poured is located proximate the top side of the beverage container. Accordingly, the beverage container must be tipped through an exaggerated rotation in order for the coffee contained therein to be discharged through the upwardly disposed spout. Such tipping can expose the hand of the user to hot vapors emanating from the heated coffee. Further, in order to fully discharge the coffee contained in the container, the container must be tipped to an orientation in which the side having the spout disposed therein is substantially downward and horizontal. The action of the operator to effect such disposition is a nearly unnatural pouring action.

A further disadvantage of the container disclosed in the '992 patent is that a spout 9 must be fixedly internally disposed in the front 13 of the container. In the production process, the spout must be separately formed and then must be fitted to the container. After insertion of the spout, the container is no longer flat when in the folded disposition, making packing and shipping more difficult.

There is a need in the industry for a disposable container to transport beverages. Clearly an advantage of such a container is the fact that the container is readily disposable after use, thereby making a return trip by the provider unnecessary. The container should be ergonomically designed in order to readily facilitate the discharge of beverage therefrom. Further, it is desirable that such container substantially shield the hand of the user from any hot vapors emanating from the hot coffee.

SUMMARY OF THE INVENTION

The present invention substantially meets the aforementioned needs of the industry. Principally, by locating the spout from which the coffee is discharged proximate the bottom side section of the container, substantially all of the coffee contained therein may be discharged with virtually no tilting action on the part of the user of the container. Additionally, a shield is provided to substantially deflect hot vapors away from the hand of the user of the container.

The present invention is a disposable container that includes support structure that is shiftable between a disposable disposition and an erect disposition, the support structure defining an interior container space when in the erect disposition. The erect support structure has a bottom side section and a generally opposed and spaced apart top side section. A first end section extends between the bottom side section and the top side section and has an aperture defined therein, the aperture being disposed proximate the bottom side section. A second end section is spaced apart from the first end section and extends between the bottom side section and the top side section.

In a further embodiment, the present invention is a disposable container that includes support structure that is shiftable between a disposable disposition and an erect disposition, the support structure defining an interior container space when in the erect disposition. The erect support structure has a first end section, the first end section having an aperture defined therein, the aperture being disposed proximate a bottom side section. A bladder for holding a liquid is disposable in the interior container space.

DETAILED DESCRIPTION OF THE DRAWINGS

Figure 2:
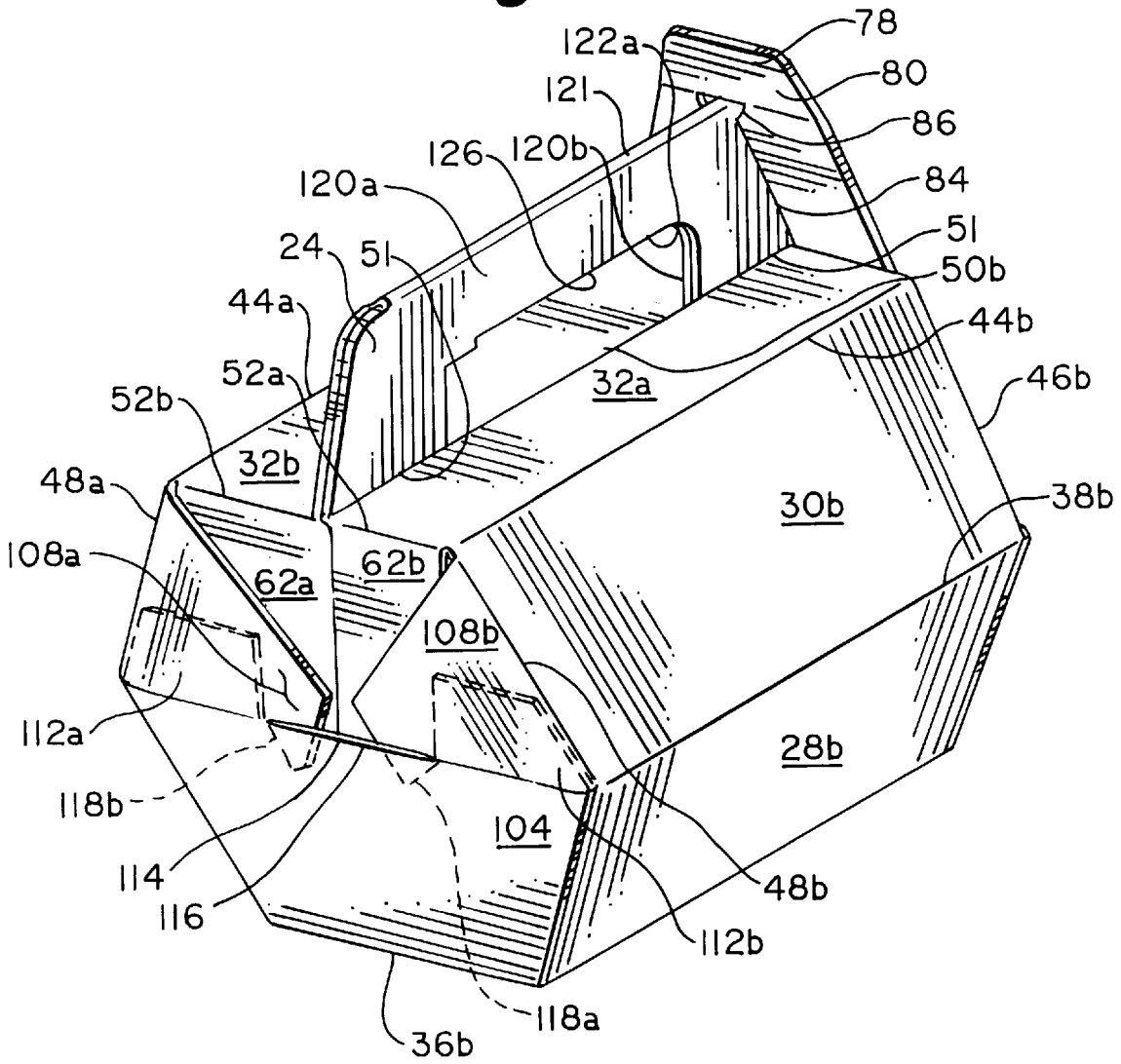
FIG. 2 is a perspective rear quarter view of the container of FIG. 1.
Figure 3:
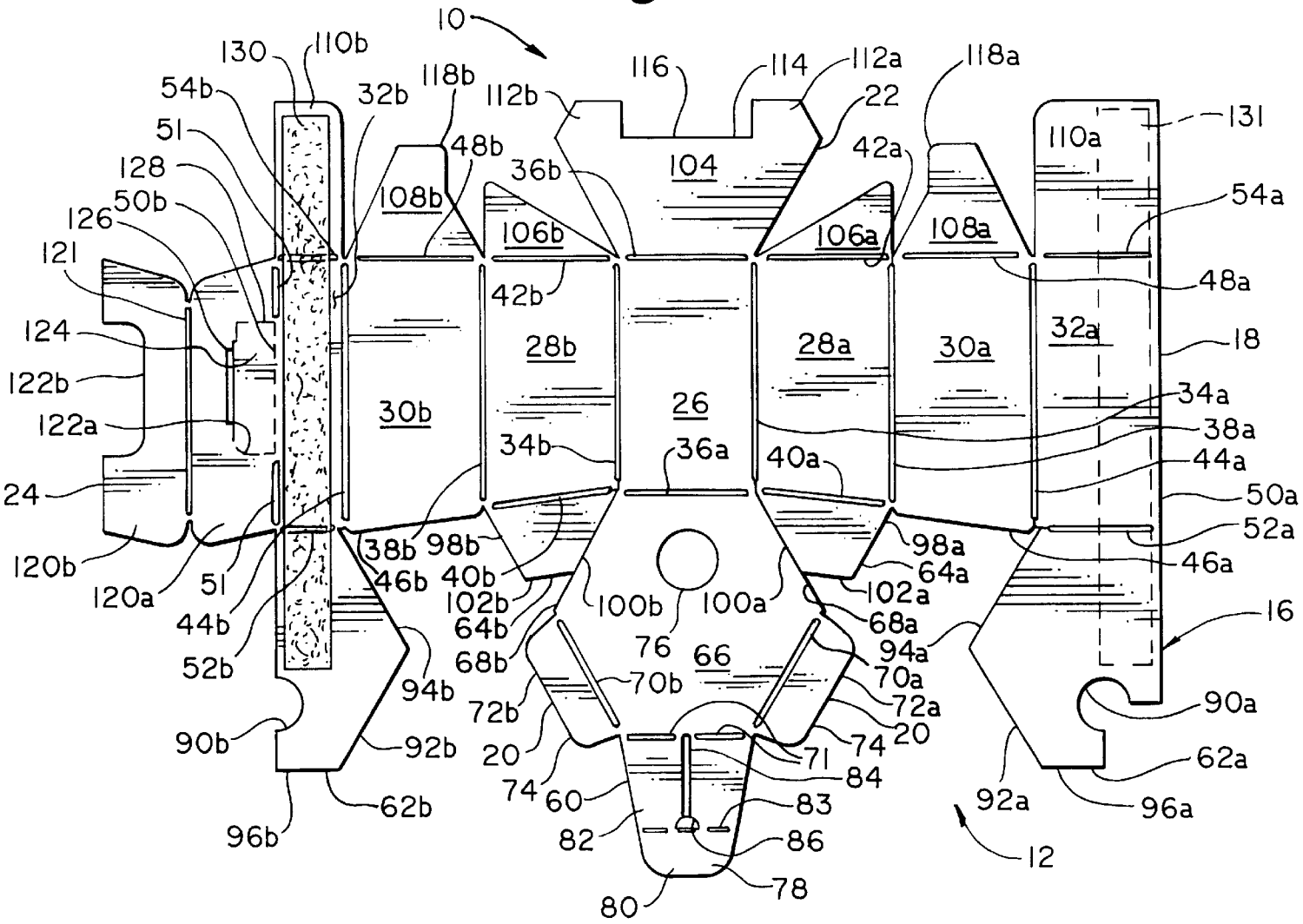
FIG. 3 is a plan form view of the container support structure blank.
Figure 4:
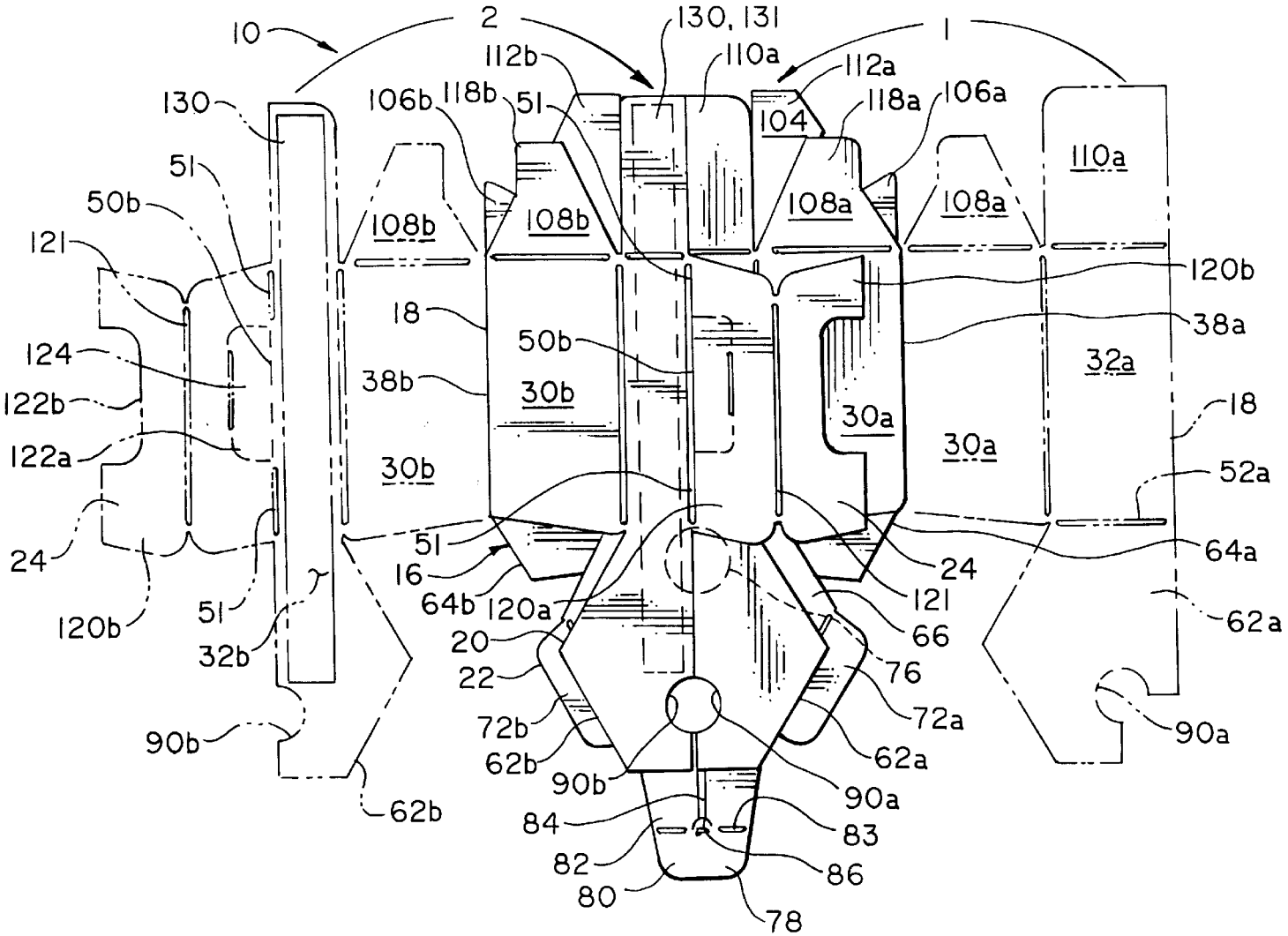
FIG. 4 is a plan form view of a container support structure blank first side in the glued configuration with the plan form view of FIG. 3 depicted in phantom.
Figures 5, 6, 6A:
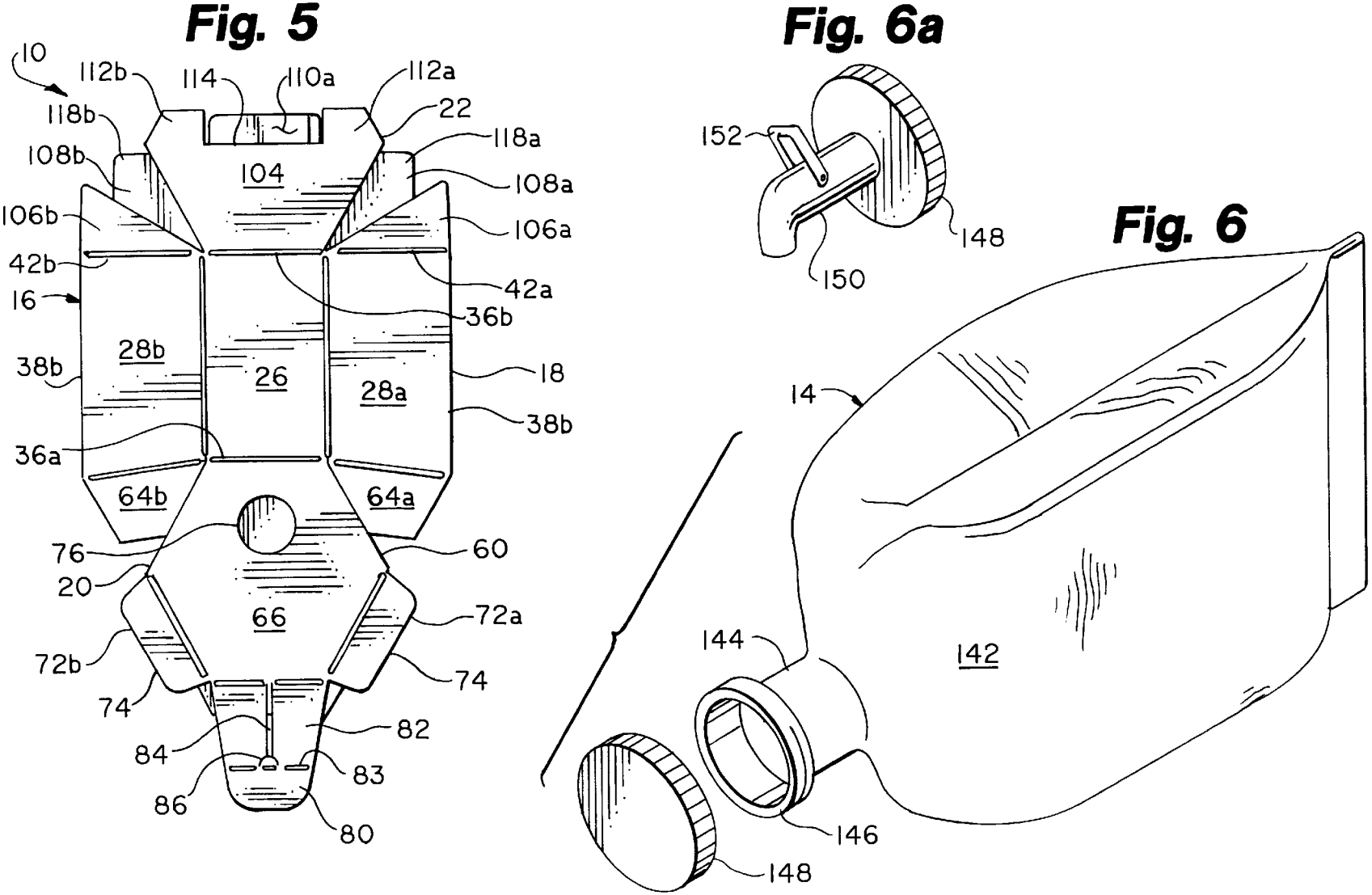
FIG. 5 is a plan form view of a container support structure blank second side in the glued configuration.
FIG. 6 is a perspective view of the container bladder.
FIG. 6A is a perspective view of a bladder cap having an integral spout.

The disposable container of the present invention is shown generally at 10 in the drawings. The disposable container 10 includes a support structure 12 and, in a preferred embodiment, a bladder 14. The support structure 12 is formed from a blank 16 as depicted in FIGS. 3–5. The blank 16 is erectable from the folded dispositions of FIGS. 3–5 to the erect dispositions of FIGS. 1 and 2.

The blank 16 of the support structure 12 is foldable to define components comprising a center support section 18, a first end support section 20, a second end support section 22, and a handle 24. The center support section 18 includes a bottom side section 26, first side sections 28*a*, 28*b*, second side sections 30*a*, 30*b*, and overlapping top side sections 32*a*, 32*b*.

The first component of the support section 12 is the bottom side section 26. The bottom side section 26 is preferably formed in a parallelogram shape defined by parallel, spaced apart fold lines 34*a*, 34*b* and parallel, spaced apart fold lines 36*a*, 36*b*. It should be noted that the fold lines 34*a*, 34*b* and 36*a*, 36*b*, as well as all the succeeding fold lines to be described, may be scored in the material forming the blank 16 in order to facilitate readily folding along such fold lines.

The first side sections 28*a*, 28*b*, are defined by the previously described fold lines 34*a*, 34*b* and the fold lines 38*a*, 38*b*, respectively. The fold lines 38*a*, 38*b* are preferably disposed in a parallel relationship with fold lines 34*a*, 34*b*. First side sections 28*a*, 28*b* are further defined by fold lines 40*a*, 40*b*. The fold lines 40*a*, 42*a*, and 40*b*, 42*b* are preferably not parallel, thereby defining first side sections 28*a*, 28*b* in generally trapezoidal shapes.

Outboard of first side sections 28*a*, 28*b* of the center support section 18 on the blank 16 depicted in FIG. 3, are second side sections 30*a*, 30*b*. The second side sections 30*a*, 30*b* are defined in part by fold lines 38*a*, 38*b* and 44*a*, 44*b*, respectively. Preferably, the fold lines 38*a* and 44*a* are disposed in a parallel relationship and the fold lines 38*b* and 44*b* are also disposed in a parallel relationship. The second side sections 30*a*, 30*b* are further defined by end margins 46*a*, 46*b*, respectively, and fold lines 48*a*, 48*b*, respectively. As with first side sections 28*a*, 28*b*, the second side sections 30*a*, 30*b* are trapezoidal in shape, the end margins 46*a*, 46*b* not being in a parallel relationship with respect to the fold lines 48*a*, 48*b*, respectively.

As depicted in FIG. 3, the overlapping top side sections 32*a*, 32*b* are disposed outboard from the blank 16 of the second side sections 30*a*, 30*b*. The overlapping top side sections 32*a*, 32*b* are defined by an edge margin 50*a*, 50*b* disposed in a parallel relationship to the fold lines 44*a*, 44*b*, respectively. The overlapping top side section 32*b* is additionally defined by the fold line 51. The fold line 51 is collinear with the edge margin 50*b*. As will be described below, handle 24 is formed integral with the overlapping top side section 32*b* along the fold line 51.

The ends of the overlapping top side sections 32*a*, 32*b* are defined by parallel and spaced apart fold lines 52*a*, 52*b* and fold lines 54*a*, 54*b*, respectively.

The second support section 12 component is the first end support section 20. The first end support section 20 of the blank 16 is formed of front outer panel 60, front inner panels 62*a*, 62*b*, and tabs 64*a*, 64*b*.

The front outer panel 60 includes a hexagonal panel 66. The hexagonal panel 66 is defined by fold line 36*a* and parallel, spaced apart fold line 71. Hexagonal panel 66 is further defined by side margins 68*a*, 68*b* adjoining fold lines 70*a*, 70*b*. Outer panel tabs 72*a*, 72*b* are formed integral with hexagonal panel 66 along fold lines 70*a*, 70*b*, respectively. The tabs 72*a*, 72*b* are defined by an outer margin 74.

A spout aperture 76 is defined in the hexagonal panel 66. The spout aperture 76 is disposed proximate the bottom side section 26 adjacent to the fold line 36*a*.

A tongue 78 is formed integral with the hexagonal panel 66 along fold line 71. The tongue 78 has an upper portion 80 separated from a lower portion 82 by the fold line 83. A slit 84 is defined in the lower portion 82 extending substantially between the fold line 71 and a semi-circular cutout 86. The semi-circular cutout 86 has its base resting along the fold line 83.

The first end support section 20 includes generally opposed inner panel halves 62*a*, 62*b*. The inner panel halves 62*a*, 62*b* are formed integral with the overlapping top side sections 32*a*, 32*b*, respectively, along the fold lines 52*a*, 52*b*, respectively. Each of the inner panel halves 62*a*, 62*b* has a cooperative cutout 90*a*, 90*b* respectively defined therein. As will be seen, the cutouts 90*a*, 90*b* cooperate to define an aperture that is generally the same size as the spout aperture 76 and is brought into registry with the spout aperture 76 when the support structure 12 is in its erect disposition. The periphery of the inner panel halves 62*a*, 62*b* is generally defined by an extension of the edge margin 50*a*, 50*b*, respectively, side margins 92*a*, 92*b*, side margins 94*a*, 94*b*, and end margins 96*a*, 96*b*, respectively. The two tabs 64*a* and 64*b* of the first end support section 20 are positioned generally between the front outer panel 60 and the two front inner panels 62*a*, 62*b*. The tabs 64*a*, 64*b* are generally trapezoidal in shape being defined by four sides. The four sides of the tabs 64*a*, 64*b* are defined by fold lines 40*a*, 40*b*, side margins 98*a*, 98*b*, side margins 100*a*, 100*b*, and end margin 102*a*, 102*b*, respectively. It should be noted that side margins 100*a* and 100*b* lie substantially coincident with side margins 68*a*, 68*b* of the front outer panel 60 and are preferably formed by making a single cut separating tabs 64*a*, 64*b* from hexagonal panel 66.

The third component of the support section 12 is the second end support section 22. Second end support section 22 of the support structure 12 is preferably formed of seven individual subcomponents. The seven individual subcomponents are bottom flap 104, ears 106*a*, 106*b*, locking tabs 108*a*, 108*b*, and top flaps 110*a*, 110*b*.

The bottom flap 104 is formed integral with the bottom side section 26 along fold line 36*b*. The bottom flap 104 has two projections 112*a*, 112*b*. The projections 112*a*, 112*b* generally flank a locking cutout 114. The locking cutout 114 is defined in part by lower margin 116.

The ears 106*a*, 106*b* are generally triangular in shape and are formed integral with the first side sections 28*a*, 28*b*, respectively, along the fold lines 42*a*, 42*b*, respectively.

The locking tabs 108*a*, 108*b* are disposed generally outboard of the locking ears 106*a*, 106*b*. The locking tabs 108*a*, 108*b* are formed integral with second side sections 30*a*, 30*b*, respectively, along the fold lines 48*a*, 48*b*, respectively. Each of the locking tabs 108*a*, 108*b* has a tab projection 118*a*, 118*b*, respectively. As will be seen, the tab projections 118*a*, 118*b* play a key role in locking the second end support section 22 in the erect configuration.

The top flaps 110*a*, 110*b* are formed integral with the overlapping top side sections 32*a*, 32*b*, respectively, along fold lines 54*a*, 54*b*, respectively.

The final major component of the blank 16 of the support structure 12 is the handle 24. The handle 24 is formed integral with the overlapping top side section 32*b* along the fold line 51.

Figure 1:
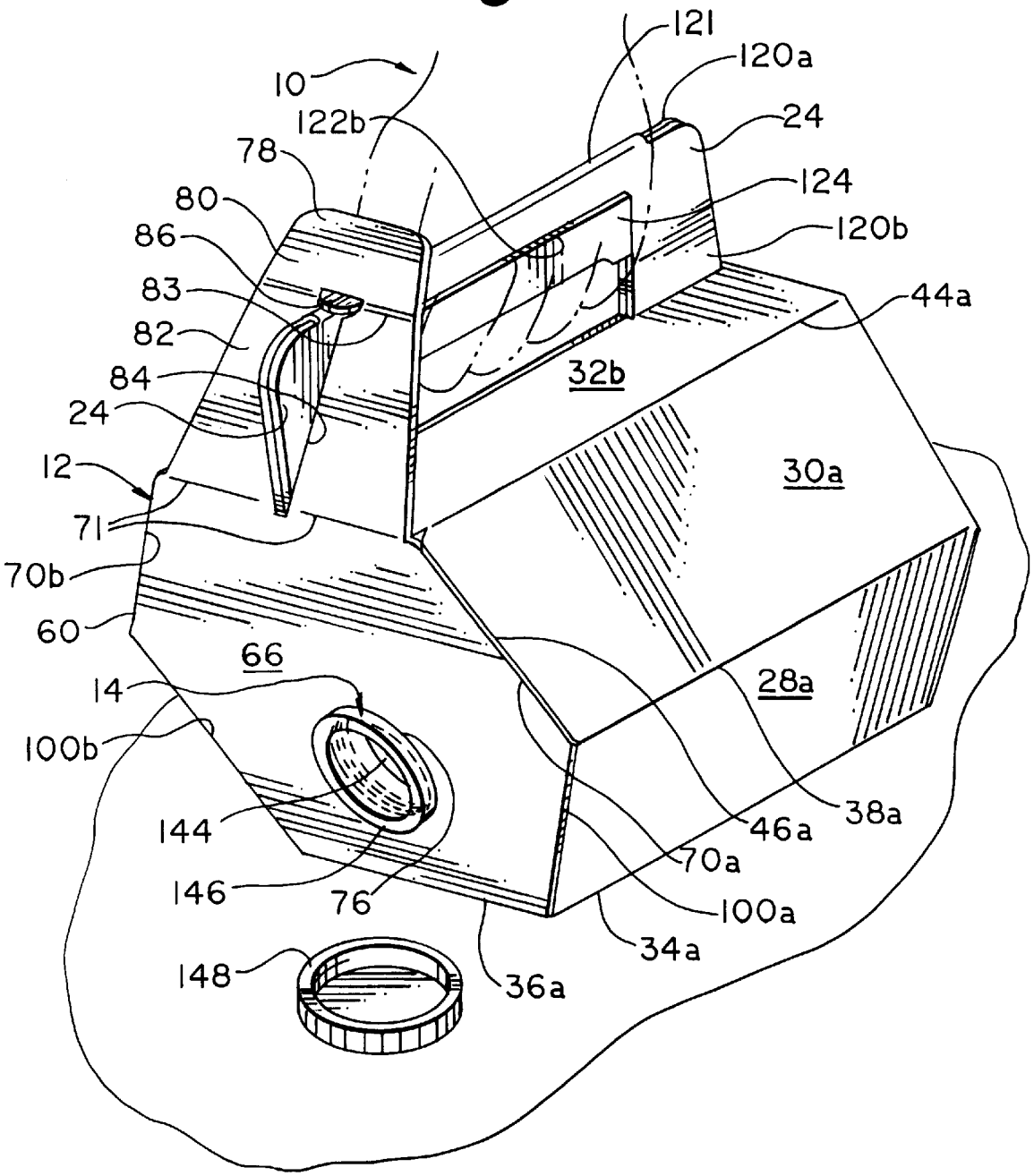
FIG. 1 is a perspective front quarter view of the container of the present invention.

The handle 24 has two handle halves 120*a*, 120*b* that are generally mirror images of each other. The handle 24 functions as a support device when grasped by a human hand, as depicted in FIG. 1. The handle halves 120*a*, 120*b* are joined along the fold line 121. Each of the handle halves 120*a*, 120*b* has a finger cutout 122*a*, 122*b*, respectively. Additionally, handle half 120*a* includes a cutout insert 124 disposed within the finger cutout 122*a*. The cutout insert 124 is formed integral with the handle half 120*a* along fold line 126. Cutout insert 124 is additionally defined by marginal cut 128 extending from the ends of the fold line 126 around the periphery of the finger cutout 122*a* and the cutout insert 124.

The blank 16 of the support structure 12 may be cut, stacked, and shipped substantially as depicted in FIG. 3. Preferably, the blank 16 is prefolded as depicted in FIGS. 4 and 5. The preferred folding action is depicted as arrows 1 and 2 in FIG. 4. The overlapping top side section 32*b* disposed on the overlapping top side section 32*a* and adhered thereto by glue or other means of bonding along glue line 130. The glue line 130 is brought into registry with strip 131 on the underside of top side section 32*a*, front inner panel 62*a* and top flap 110*a*. Strip 131 is depicted in phantom in FIG. 3.

To erect the support structure 12 of the disposable container 10 as depicted in FIGS. 4 and 5, pressure may be applied inwardly on the fold lines 38*a* and 38*b*. It should be noted that in the folded configuration of FIGS. 4 and 5, the fold lines 38*a*, 38*b* form the side margin of the folded blank 16. Such pressure causes the center support section 18 to form a generally hexagonal shape in cross section as depicted in FIGS. 1 and 2. The first end support section 20 and the second end support section 22 may then be put in place to afford an element of rigidity to the now hexagonal center support section 18.

Commencing with the second end support section 22 (as depicted in FIG. 2), in a preferred order, the top flap 110*a*, 110*b* is folded downward through an arc of approximately 90 degrees. It should be noted that due to the gluing along glue line 130, the top flaps 110*a*, 110*b* are held together as a unitary structure.

The next step is to fold the two ears 106*a*, 106*b* inward along fold lines 42*a*, 42*b*. The ears 106*a*, 106*b* are rotated through an arc of approximately 90 degrees to lie in substantially the same plane as the top flap 110*a*, 110*b*.

The next step is to fold the bottom flap 104 upward through an arc of approximately 90 degrees such that it partially overlies the top flaps 110*a*, 110*b* in a parallel relationship thereto.

Finally, the locking tabs 108*a*, 108*b* are rotated inward along fold lines 48*a*, 48*b*, respectively. Such rotation through an arc of approximately 90 degrees provides that a portion of the respective locking tabs 108*a*, 108*b* overlies the projections 112*a*, 112*b* of the bottom flap 104. The tab projections 118*a*, 118*b* are then tucked in behind the lower margin 116 of the locking cutout 114 of the bottom flap 104 to create an interlocking relationship between the locking tabs 108*a*, 108*b* and the bottom flap 104. This interlocking relationship locks the second end support section 22 in place providing a measure of rigidity to both the second end support section 22 and the center support section 18 of the blank 16.

Turning to the first end support section 20 (as depicted in FIG. 1), erection of the first end support section 20 is accomplished first by rotating the inner panel halves 62*a*, 62*b* downward through an arc of substantially 90 degrees along the fold line 52*a*, 52*b*. It should be noted that inner panel half 62*b* overlies a portion of inner panel 62*a* and is affixed thereto along the previously noted glue line 130. In such disposition, the cutouts 90*a*, 90*b* act cooperatively to define an aperture having substantially the same shape as the spout aperture 76. In such disposition, the end margins 96*a*, 96*b* are substantially parallel to and proximate the fold line 36*a*. The tabs 64*a*, 64*b* may then be folded inward by rotating the tab 64*a*, 64*b* through a substantially 90 degree arc about the respective fold lines 40*a*, 40*b*.

The front outer panel 60 is then rotated into place by folding the front outer panel 60 upward through an arc of substantially 90 degrees about the fold line 36*a*. Prior to reaching the full upward travel of the front outer panel 60, the tabs 72*a*, 76*b* are folded inward along fold lines 70*a*, 70*b* such that the tabs 72*a*, 72*b* frictionally engage the inner surface of the second side sections 30*a*, 30*b*. The fold lines 70*a*, 70*b* are then parallel to and proximate the end margins 46*a*, 46*b* of the second side sections 30*a*, 30*b*, respectively. The disposition of the front outer panel 60 with respect to the front inner panel 62*a*, 62*b* is such that the spout aperture 76 is in registry with the aperture defined by cutouts 90*a*, 90*b*. It should be noted that preferably the length dimension of the top side sections 32*a*, 32*b* (taken along fold lines 44*a*, 44*b*) is greater than the length dimension of bottom side section 26 (taken along fold lines 34*a*, 34*b*). The first end support section 20 then slants rearward from the fold line 71 to the fold line 36*a* and is therefore not parallel with second end support section 22.

At this point, the handle 24 is placed into its erect disposition. This is accomplished by rotating the handle 24 through an arc of approximately 90 degrees along the fold line 51. The handle half 120*b* is then rotated downward along fold line 121 through an arc of substantially 180 degrees to lie parallel with handle 120. At this point the finger cutouts 122*a*, 122*b* are in registry. The cutout insert 124 is then rotated through an arc of substantially 180 degrees such that the cutout insert 124 passes through the finger cutout 122*b* and lies along side the surface of the handle half 120*b*. In this way, the cutout insert 124 tends to lock the handle halves 120*a*, 120*b* together.

Finally, the tongue 78 is folded rearward along fold line 71 to a point where the slit 84 engages the handle 24, thereby assisting in locking the handle halves 120*a*, 120*b* together. The upper portion 80 of the tongue 78 is then bent rearward about the fold line 83 to a position substantially overlying the front portion of the handle 24. In this disposition, the upper 80 and the lower portion 82 of the tongue 78 substantially shield the hand of a user that is grasping the handle 24 from hot liquid vapors.

In a preferred embodiment, the container 10 includes a liquid bladder 14. The liquid bladder 14 of the present invention is depicted in FIGS. 6 and 6*a*. Bladder 14 includes a liquid receptacle 142. In a preferred embodiment, the liquid receptacle 142 is formed of a clear plastic material that is designed to retain and hold liquids having a temperature of up to 250 degrees F. The liquid receptacle 142 is bonded to a semi-rigid neck 144. The neck 144 preferably has a circular cross section having a diameter that is slightly less than the diameter of the spout aperture 76. The neck 144 terminates in a threaded mouth 146. The threaded mouth 146 has a diameter that is greater than the diameter of the spout aperture 76. A threaded cap 148 is provided to sealingly engage the threads of the threaded mouth 146.

In an alternative embodiment of the bladder 14, depicted in FIG. 6*a*, the threaded cap 148 has a preferably integrally formed spigot 150. The spigot is provided with a valve handle 152 for selectively opening and closing a valve (not shown) disposed within the spigot 150.

In operation, after erection of the support structure 12 of the disposable container 10, the liquid receptacle 142 of the bladder 14 is inserted through the spout aperture 76. The neck 44 is engaged within the spout 76. When the support structure 12 is supported on its second end support section 22, the liquid receptacle 142 depends from the neck 144 and is supported by the periphery of the threaded mouth 146 (the mouth 146 opening generally upward). In this disposition, the threaded cap 148 may be removed from the threaded mouth 146 and liquid may be poured into the liquid receptacle 142 through the neck 144.

After the liquid receptacle 142 has been substantially filled with liquid, the threaded cap 148 can be sealingly engaged with the threaded mouth 146. The support structure 12 of the disposable container 10 may be then turned to any other disposition without fear of discharge of liquid from the bladder 14.

In the alternate embodiment in which the threaded cap contains a threaded spigot 150, the disposable container 10 may be supported on its bottom side section 26 proximate the edge of a supporting structure such that the spigot 150 projects over the edge of the supporting structure. A cup or other liquid receptacle may be then placed beneath the threaded spigot 150. Actuation of the valve handle 152 to open the valve (not shown) will then result in the discharge of liquid from the liquid receptacle 142.

It should be noted that the support structure 12 of the disposable container 10 has a plurality of uses. One such use is as a biodegradable semi-permanent birdhouse. For such use, the support structure 12 is preferably formed of a weather resistant fiberboard or plastic material. In use, the disposable container 10 is placed in a location to attract nesting birds. At the end of the nesting season, when an ordinary birdhouse must be cleaned out, the disposable container 10 is simply removed and disposed of with the accumulated nesting material inside. For such use, the cutouts 122*a*, 122*b* in the handle 24 are preferably a circular aperture through which a cord may be passed to suspend the container 10 from a tree branch or the like.

Those skilled in the art will recognize that there are numerous variations and modifications of this invention which are encompassed by its scope. Accordingly, the foregoing description should be considered illustrative of the invention and not deemed to limit its scope.

What is claimed is:

1. A disposable container, comprising:

support structure, being shiftable between a disposable disposition and an erect disposition, the support structure defining an interior container space when in the erect disposition, the erect support structure having a first end section, the first end section having an aperture defined therein, the aperture being disposed proximate a bottom side section, a top side section, the top side section being generally opposed to and spaced apart from the bottom side section, a second end section being spaced apart from the first end section and extending between the bottom side section and the top side section, and wherein the first end section extends between the bottom side section and the top side section; and a bladder for holding a liquid, the bladder being disposable in the interior container space and having a bladder mouth being disposed external to the first end section aperture.

2. The container of claim 1 further including a plurality of side sections extending between the top side section and the bottom side section to define in part the interior container space.

3. The container of claim 2 wherein the top side section and the bottom side section, in cooperation with the plurality of side sections, define a structure having a substantially hexagonal cross section.

4. The container of claim 1 further including a support device operably coupled to a top side section for supporting the support structure depending therefrom.

5. The container of claim 4 wherein the support device has an aperture defined therein.

6. The container of claim 5 further including a shield for shielding at least a portion of the support device.

7. The container of claim 6 wherein the shield extends from the top side section to the support device.

8. The container of claim 7 wherein a top side section is formed of a first top side section half and a second top side section half, the first top side section half and the second top side section half being operably, fixedly coupled together to form the top side section.

9. The container of claim 1 wherein the bladder further includes a bladder neck defining a fluid spout therein, the bladder neck being disposable in the top side section aperture and being in fluid communication with a fluid receptacle.

10. The container of claim 9 wherein the bladder further includes a sealable mouth operably coupled to the bladder neck, the mouth having dimensions greater than the aperture, such that the mouth is engageable by the top end section peripheral to the aperture.

11. The container of claim 10 further including sealing means for sealingly, selectively engaging the mouth.

12. A disposable container, comprising:

support structure, being shiftable between a disposable disposition and an erect disposition, the support structure defining an interior container space when in the erect disposition, the erect support structure having a first end section, the first end section having an aperture defined therein, the aperture being disposed proximate a bottom side section, a top side section, the top side section being generally opposed to and spaced apart from the bottom side section, a second end section being spaced apart from the first end section and extending between the bottom side section and the top side section, and wherein the first end section extends between the bottom side section and the top side section and the first end section is disposed relative to the second end section in a non-parallel relationship, and the top side section and the bottom side section each have parallelogram plan forms having a length and a width dimension, the length dimension of the top side section being greater than the length dimension of the bottom side section; and a bladder for holding a liquid, the bladder being disposable in the interior container space and having a bladder mouth being disposed external to the first end section aperture.

13. The container of claim 13 further including a plurality of side sections extending between the top side section and the bottom side section to define in part the interior container space.

14. The container of claim 14 wherein the top side section and the bottom side section, in cooperation with the plurality of side sections, define a structure having a substantially hexagonal cross section.

* * * * *

UNITED STATES PATENT AND TRADEMARK OFFICE

CERTIFICATE OF CORRECTION

PATENT NO. : 6,209,781 B1
DATED : April 3, 2001
INVENTOR(S) : Sylvester et al.

It is certified that error appears in the above-identified patent and that said Letters Patent is hereby corrected as shown below:

Column 4,
Line 1, after "respectively." begin a new paragraph.
Lines 18 and 35, delete "110*a*" and insert -- 110*a* --.

Column 8,
Line 3, delete "7" and insert -- 3 --.
Line 48, delete "13" and insert -- 12 --.
Line 52, delete "14" and insert -- 13 --.

Signed and Sealed this

Eighth Day of April, 2003

JAMES E. ROGAN
*Director of the United States Patent and Trademark Office*